United States Patent [19]

Edwards

[11] 4,371,349

[45] Feb. 1, 1983

[54] TILT MOUNT FOR MOUNTING AN OUTBOARD MOTOR ON THE SIDE OF A CANOE

[76] Inventor: Howard W. Edwards, 705 24th St., Cloquet, Minn. 55720

[21] Appl. No.: 244,099

[22] Filed: Mar. 16, 1981

[51] Int. Cl.[3] ..... B63H 21/26

[52] U.S. Cl. ..... 440/56

[58] Field of Search ..... 440/6, 7, 53, 54, 62, 440/55, 56, 71, 900; 248/640–643

[56] References Cited

U.S. PATENT DOCUMENTS

| | | | |
|---|---|---|---|
| 2,706,959 | 4/1955 | Downs | 440/56 |
| 2,972,977 | 2/1961 | Hausmann | 440/65 |
| 3,357,393 | 12/1967 | Urbassik | 440/62 |
| 3,434,448 | 3/1969 | Woodfill | 440/56 |
| 3,580,212 | 5/1971 | Fortson | 440/6 |
| 3,698,672 | 10/1972 | Gilbert | 440/900 |
| 4,019,703 | 4/1977 | Meredith et al. | 440/900 |

*Primary Examiner*—Trygve M. Blix

*Assistant Examiner*—Jesus D. Sotelo

*Attorney, Agent, or Firm*—Wicks & Nemer

[57] ABSTRACT

A tilt mount for mounting an outboard motor on the side of a canoe including a U-shaped bracket formed of a flange which terminates at its upper end in a right angularly disposed cross bar portion. The bar portion terminates in a right angularly disposed base portion parallely disposed to and spaced from the flange which forms a U-shaped member adapted to fit over the gunwale of a canoe. A pair of clamp members are mounted on the flange adapted to engage a gunwale between the clamps and the base portion. A motor mount member is pivotally mounted on the cross bar adapted to pivot in either direction from the vertical and a stop member is connected to and extends from the lower end of the base against which the shaft of the outboard member normally abuts in a vertical position. If the lower end of the motor shaft or propeller thereon strikes an underwater object, the motor tilts up on the mount.

9 Claims, 4 Drawing Figures

TILT MOUNT FOR MOUNTING AN OUTBOARD MOTOR ON THE SIDE OF A CANOE

SUMMARY

The invention relates to an improvement in outboard motors and more particularly to the electric type that has no tilt-up feature. More specifically, the invention relates to a mount for mounting the outboard motor on the gunwale of either side of a canoe whereby the motor tilts upwardly if the same strikes an underwater object as the canoe is propelled forwardly or it is desired to inspect the shaft or the propeller on the lower end thereof.

The mount includes a bracket having clamp members for mounting on the gunwale of a canoe. The bracket has a motor mount pivotally mounted on the bracket for pivotal movement in either direction so that the mount may be used on either side of a canoe. A stop member extends outwardly from the base against which the motor abuts in a vertical position. When the shaft or propeller thereon strikes an underwater object, the motor tilts upwardly thereby greatly reducing damage to the motor.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
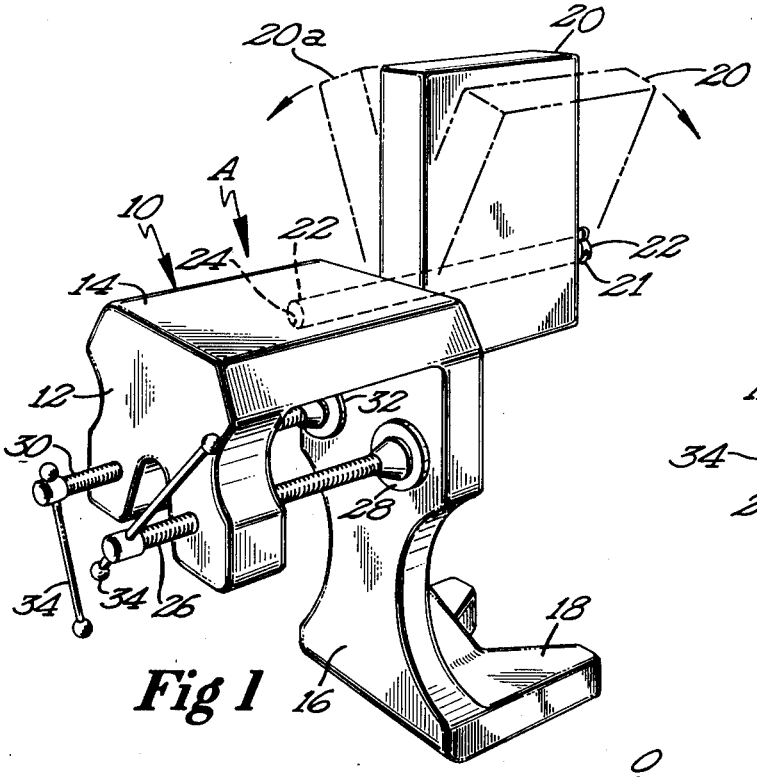
FIG. 1 is a perspective view of a tilt-mount for mounting an outboard motor on a canoe and embodying the invention with the tilt member shown in full and phantom outline.

Referring to the drawings in detail, the tiltable outboard motor mount A includes the U-shaped bracket 10 which releasably mounts on the gunwale G of a canoe or boat. The bracket 10 includes the flange portion 12 which terminates at its upper end in the right angularly disposed cross bar portion 14. The bar portion 14 terminates in the right angularly disposed base portion 16 which is parallely disposed to and spaced from the flange portion 12 whereby the bracket is adapted to fit over the gunwale of the side of a canoe.

The lower end of the base portion 16 terminates in the right angularly disposed stop 18 which is substantially parallel to the bar portion and it extends outwardly from the base portion 16. The numeral 20 designates a tilt mount member substantially flat and rectangular in formation so as to accommodate the clamping mechanism hereinafter referred to of the outboard illustrated as O. The tilt mount member 20 is tiltably mounted on the cross bar portion by means of the pin 22 secured at its inner portion in one form of a press fit in a hole formed in the cross bar 14 with the outer end portion extending through a hole 24 extending through the tilt mount member for tilting of the mount in either direction. The pin 22 may be molded or cast in a bar portion 14 when the bar portion is made of plastic or metal. The mount is tiltable in either direction so that it can be mounted on either side of a canoe or boat for operation of the unit with the motor O thereon. The tilt mount 20 is held in place on the pin 22 by means of the cotter key 21.

Figure 4:
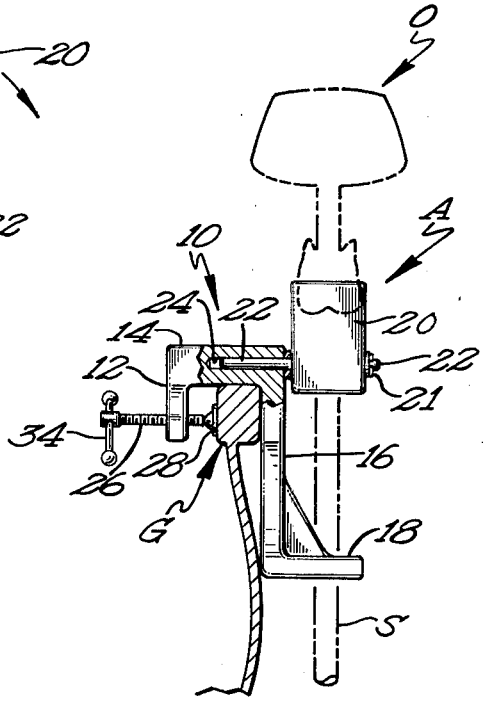
FIG. 4 is a sectional view on the line 4—4 of FIG. 2.

The numeral 26 designates a first threaded clamp rod member which extends through the flange 12 in threaded engagement therewith, and the rod has on the inner end thereof the foot 28 which is brought into pressure engagement with the inside surface of the gunwale of a canoe particularly as illustrated in FIG. 4.

A second threaded rod clamp member 30 is also provided which is through the flange 12 in threaded engagement therewith, and the rod has on the inner end thereof the foot 32. Each of the clamp rods includes a handle 34 for rotative screwing engagement of the clamp rods to the gunwale of a boat.

Figure 2:
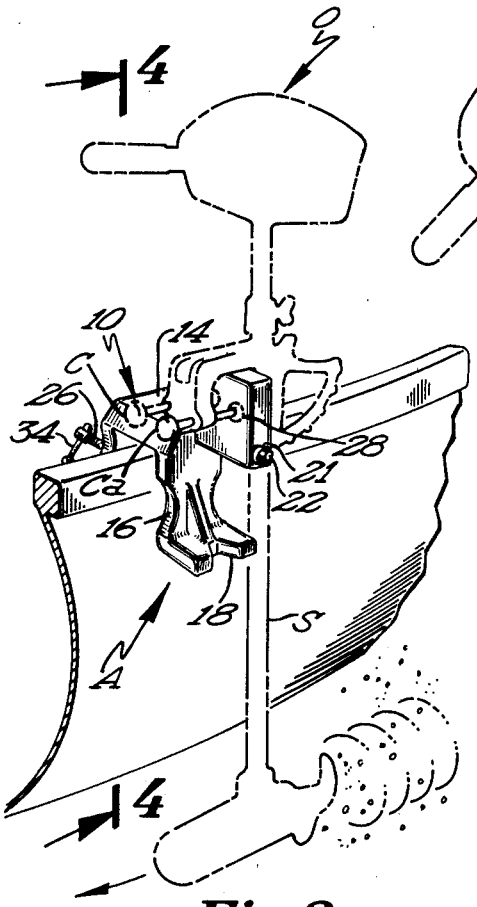
FIG. 2 is a perspective view of the tilt mount shown in position on the gunwale of a canoe with an outboard motor mounted on the mount.
Figure 3:
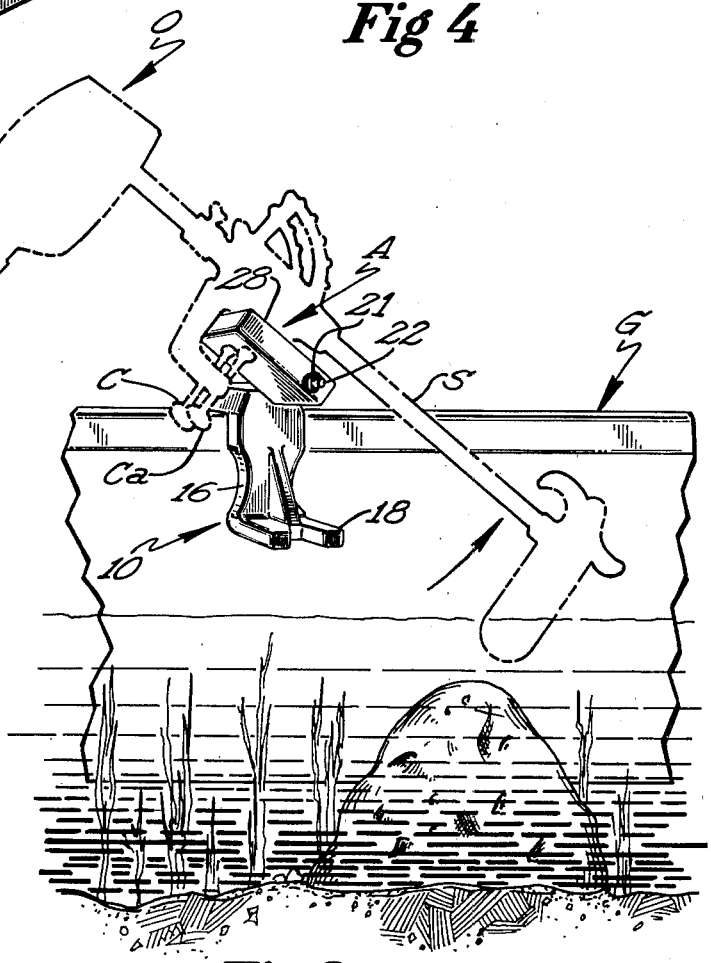
FIG. 3 is a side elevational view of the mount and a motor thereon shown in a tilted up position illustrated as having struck the rock object shown.

In use of the device A, the bracket 10 is engaged with the gunwale G of the boat and tightly secured thereon by means of the clamping rods 26 and 30, particularly FIG. 4. The motor O is then positioned on the mount member 20 and secured thereon by means of motor clamp members C and Ca, particularly FIGS. 2 and 3. It will be noted that the mount member 20 and the stop 18 are so related that when the motor is mounted, the shaft S of the motor is against the stop 18 such as in FIG. 2 and in that position, the motor is operated and moves the canoe in the direction of the arrow as in FIG. 2. When the lower end of the shaft S strikes an underwater object such as the rock R, FIG. 3, the motor is free to pivot or kick upwardly, FIG. 3, to relieve the shock and greatly reduce the chance of damage to the lower parts of the motor and propeller.

It will be further noted that the mount A may be used on either the port or starboard side of the canoe by simply reversing the clamping position of the motor on the tilt mount member 20, and the operative results are the same, for the tilt mount member pivots in either direction as shown in phantom outline in FIG. 1. Also, the stop member 18 functions as such with either position of the motor on the tilt mount member, i.e. with the bracket on either side of the canoe. Additionally, the motor is easily and tiltably raised to a non-operative position when desired and in such a raised position the same may be so retained by tying the motor to the gunwale of the canoe. The device A is particularly useable with an electric outboard motor which has no pivotal means.

Having thus described the invention, what is claimed as new and desired to be secured by Letters Patent is:

1. A tilt mount for mounting an outboard motor on the side of a canoe or the like comprising, in combination:

(a) a bracket, (b) means for securing the bracket to a portion of a canoe, (c) a motor mounting member on which an outboard motor is secured, (d) means pivotally mounting said motor mounting member on said bracket including:

(A) a pin mounted on said bracket having one end extending from the bracket and a second end extending freely through (B) a hole formed in said motor mounting member, (e) said bracket having a stop member extending therefrom and against which a shaft of a motor normally engages when it is secured on said motor mounting member, said motor mounting member and a motor thereon tilting upwardly when the lower portion of the motor strikes an underwater object.

2. The device of claim 1 in which said bracket includes (a) a flange terminating in (b) a bar portion which terminates in (c) a base portion parallelly disposed to said flange.

3. The device of claim 2 in which said motor mounting member includes a body having flat opposed surfaces for engagement by clamping members of an outboard motor.

4. The device of claim 1 in which said motor mounting member includes a body having flat opposed surfaces for engagement by clamping members of an outboard motor.

5. The device of claim 1 in which said stop member includes parallelly disposed and spaced edges against either of which a motor may position.

6. A tilt mount for mounting an outboard motor on the side of a canoe or the like comprising:

(a) a bracket, (b) means for securing the bracket to a portion of a canoe, (c) a motor mounting member on which an outboard motor is secured, (d) means pivotally mounting said motor mounting member on said bracket, (e) said bracket having a stop member extending therefrom and against which a shaft of a motor normally engages when it is secured on said motor mounting member, said motor mounting member and a motor thereon tilting upwardly when the lower portion of the motor strikes an underwater object, and wherein said motor mounting member is pivotal in either direction from a vertical position.

7. The device of claim 6 in which said stop member includes parallelly disposed and spaced edges against either of which a motor may position.

8. The device of claim 6 in which said means pivotally mounting said motor mounting means on said bracket includes (a) a pin mounted on said bracket extending therefrom and extending freely through (b) a hole formed in said motor mounting member.

9. The device of claim 7 or 8 in which said motor mounting member includes a body having flat opposed surfaces for engagement by clamping members of an outboard motor.

* * * * *